US011568705B2

(12) United States Patent
Lamb et al.

(10) Patent No.: US 11,568,705 B2
(45) Date of Patent: Jan. 31, 2023

(54) METHOD AND SYSTEM FOR A GAMING SYSTEM USER INTERFACE

(71) Applicant: Video Gaming Technologies, Inc., Franklin, TN (US)

(72) Inventors: William Douglas Lamb, Eagleville, TN (US); Daniel William Rice, Thompson Station, TN (US); Victor Brent McClearen, Cookeville, TN (US); Charles Stanley Curbbun, Encinitas, CA (US); Arvin Grande Abadilla, Encinitas, CA (US); Matthew Kranz, Encinitas, CA (US); Julian Groeli, San Diego, CA (US); Blake Chuanlun Wang, San Diego, CA (US); Jin Chen, Carlsbad, CA (US); William John Leach, San Diego, CA (US)

(73) Assignee: VIDEO GAMING TECHNOLOGIES, INC., Franklin, TN (US)

( * ) Notice: Subject to any disclaimer, the term of this patent is extended or adjusted under 35 U.S.C. 154(b) by 144 days.

(21) Appl. No.: 17/107,526

(22) Filed: Nov. 30, 2020

(65) Prior Publication Data

US 2021/0082237 A1 Mar. 18, 2021

Related U.S. Application Data

(62) Division of application No. 14/498,638, filed on Sep. 26, 2014, now Pat. No. 10,854,039.

(51) Int. Cl.
*G07F 17/32* (2006.01)
*G07F 17/34* (2006.01)

(52) U.S. Cl.
CPC ..... *G07F 17/3213* (2013.01); *G07F 17/323* (2013.01); *G07F 17/3209* (2013.01);
(Continued)

(58) Field of Classification Search
CPC ..... G07F 17/3213; G07F 17/3209; G07F 17/3211; G07F 17/3216; G07F 17/3227; G07F 17/323; G07F 17/3239; G07F 17/34
See application file for complete search history.

(56) References Cited

U.S. PATENT DOCUMENTS 5,302,015 A * 4/1994 Du Vall ..... A47B 21/0314 312/282
D399,670 S 10/1998 Miller
(Continued)

FOREIGN PATENT DOCUMENTS

WO 2014108141 A1 7/2014

OTHER PUBLICATIONS

Notice of Allowance dated Aug. 13, 2020 for U.S. Appl. No. 14/498,638 (pp. 1-5).

*Primary Examiner* — Thomas H Henry
(74) *Attorney, Agent, or Firm* — Armstrong Teasdale LLP

(57) ABSTRACT

A gaming machine includes a base, a columnar pedestal extending vertically from the base, and a button deck adjustably coupled to the pedestal. The button deck includes an upper surface including a transparent touchscreen element, a lower surface opposite the upper surface, and a button deck body extending therebetween. At least one of the lower surface and the body include one or more transparent display elements, the one or more transparent display elements are configured to generate images of gaming machine control actuators viewable on the upper surface. The transparent touchscreen element is configured to receive touches and gestures indicating control inputs. The gaming machine also includes a player tracking card reader positioned within the button deck and accessible through a slot in a front edge of the button deck, the player tracking card
(Continued)

reader communicatively coupled to a player tracking display area of the gaming machine.

20 Claims, 4 Drawing Sheets

(52) U.S. Cl.
CPC ..... *G07F 17/3211* (2013.01); *G07F 17/3216* (2013.01); *G07F 17/3227* (2013.01); *G07F 17/3239* (2013.01); *G07F 17/34* (2013.01)

(56) References Cited

U.S. PATENT DOCUMENTS 6,008,784 A 12/1999 Acres
6,102,394 A 8/2000 Wurz
6,102,476 A 8/2000 May
6,217,448 B1 4/2001 Olsen
6,514,145 B1 2/2003 Kawabata
6,530,842 B1 3/2003 Wells
6,637,844 B1 10/2003 Luciano, Jr.
6,646,695 B1 11/2003 Gauselmann
7,166,029 B2 1/2007 Enzminger
7,217,191 B2 5/2007 Cordell
7,562,872 B2 7/2009 Okada
7,665,939 B1 * 2/2010 Cardona ..... B60P 7/0815 410/11
7,699,315 B2 4/2010 Hirato
7,896,746 B2 3/2011 Borissov
7,918,725 B2 4/2011 Baerlocher
7,955,176 B2 6/2011 Tastad
8,012,027 B2 9/2011 McGahn
8,047,916 B2 11/2011 Seelig
8,096,884 B2 1/2012 Beadell
8,113,517 B2 2/2012 Canterbury
8,118,681 B2 2/2012 Mattice
8,137,185 B2 3/2012 Crowder, Jr.
8,177,637 B2 * 5/2012 Beadell ..... G07F 17/3216 463/31
8,216,046 B2 7/2012 Ikeya
8,216,074 B2 7/2012 Sakuma
8,262,480 B2 9/2012 Cohen
8,430,756 B2 4/2013 McComb
8,439,761 B2 5/2013 O'Keene
8,715,079 B1 5/2014 Loose
8,740,706 B2 6/2014 Klein
2002/0084395 A1 * 7/2002 Johnson ..... A47B 46/005 248/286.1
2004/0149866 A1 8/2004 Boucher
2005/0026702 A1 * 2/2005 Cole ..... G07F 17/32 463/46
2005/0113163 A1 5/2005 Mattice
2006/0014586 A1 1/2006 Gatto
2006/0073868 A1 4/2006 Nordman
2006/0183544 A1 8/2006 Okada
2007/0035164 A1 2/2007 North
2007/0045960 A1 3/2007 Knoll
2007/0197301 A1 8/2007 Cole
2008/0182642 A1 7/2008 Cole
2008/0194326 A1 8/2008 Brunet De Courssou
2009/0102419 A1 4/2009 Gwon
2009/0176568 A1 7/2009 Reddy
2009/0187125 A1 7/2009 Tran
2009/0233681 A1 9/2009 Tsukahara
2009/0264194 A1 10/2009 Kompella
2009/0264195 A1 10/2009 Kompella
2009/0276320 A1 11/2009 Butler
2009/0280911 A1 11/2009 Tsao
2010/0075755 A1 3/2010 Steelman
2010/0087249 A1 4/2010 Rowe
2010/0120530 A1 5/2010 Lesley
2010/0144420 A1 6/2010 Fiore
2010/0201165 A1 * 8/2010 Dankovich ..... A47C 7/38 248/398
2011/0118034 A1 5/2011 Jaffe
2012/0004030 A1 1/2012 Kelly
2012/0051520 A1 3/2012 Hoernig
2012/0122569 A1 5/2012 Kowolik
2013/0137524 A1 5/2013 Scott
2014/0141886 A1 5/2014 Woels
2015/0087403 A1 3/2015 Castro

* cited by examiner

METHOD AND SYSTEM FOR A GAMING SYSTEM USER INTERFACE

CROSS REFERENCE TO RELATED APPLICATIONS

This application is a divisional of, and claims priority to, U.S. application Ser. No. 14/498,638, filed Sep. 26, 2014, entitled "METHOD AND SYSTEM FOR A GAMING SYSTEM USER INTERFACE," the contents of which are hereby incorporated in their entirety.

BACKGROUND

This description relates to gaming machines, and, more particularly, to a method and system for enhancing player comfort and ergonomics in gaming machines.

Gaming machines have evolved to a substantially consistent form due to interchangeability and standardization considerations. For example, button layouts follow a standard linear arrangement in which players' must adjust their reach to accomplish different actions. Rather than assuming a more ergonomic configuration that is less fatiguing to players, buttons of gaming machines are arranged at consistent intervals in a straight line pattern. Additionally, gaming cabinets have a footprint at floor level that is either similar to and that exceeds the dimensions of the game itself. Often, gaming machines are placed on box stands to elevate them to a consistent height. However, the box stands also extend to a footprint that meets or exceeds the dimensions of the game. Players at such gaming machines are constantly at odds of being near enough to the machine to comfortably reach the game buttons, but far enough away from the gaming machine to have room to place their feet in front of them. Placement of the button panel or button deck is generally fixed on the front of the cabinet and is not adjustable to facilitate game play or player comfort.

Such discomforts and poor ergonomics affect player satisfaction with the gaming machine and the gaming experience and may affect revenues of the affected machines.

BRIEF DESCRIPTION

In an aspect, a gaming machine includes a base, a columnar pedestal extending vertically from the base, the pedestal having a cross-sectional area, a width, and a depth that are less than each of a corresponding cross-sectional area, width, and depth of the base, and a button deck adjustably coupled to the pedestal. The button deck includes an upper surface including a transparent touchscreen element, a lower surface opposite the upper surface, and a button deck body extending therebetween. At least one of the lower surface and the body including one or more transparent display elements, the one or more transparent display elements configured to generate one or more images of gaming machine control actuators viewable on the upper surface, the transparent touchscreen element configured to receive from a user at least one of touches and gestures indicating control inputs to the gaming machine, the at least one of touches and gestures corresponding to the generated images. The gaming machine also includes a player tracking card reader positioned within the button deck and accessible through a slot in a front edge of the button deck, the player tracking card reader communicatively coupled to a player tracking display area of the gaming machine.

In another aspect, a gaming machine includes a pedestal configured to support one of a plurality of interchangeable game cabinets through a pedestal mating flange configured to engage a complementary game cabinet flange, one or more mating plugs configured to engage a complementary one or more mating plugs positioned proximate the mating flanges, the mating plugs configured to join respective signal and power conduits between the pedestal and the game cabinet. The gaming machine also includes a button deck adjustably coupled to the pedestal. The button deck includes an upper surface including a transparent touchscreen element, a lower surface opposite the upper surface, and a button deck body extending therebetween. At least one of the lower surface and the body including one or more transparent display elements, the one or more transparent display elements configured to generate one or more images of gaming machine control actuators viewable on the upper surface, the transparent touchscreen element configured to receive from a user at least one of touches and gestures indicating control inputs to the gaming machine, the at least one of touches and gestures corresponding to the generated images.

In a further aspect, a gaming machine pedestal includes a button deck adjustably coupled to the pedestal, the button deck including one or more extendable arms, each arm coupled at one end to the pedestal and at a second end to the button deck, the button deck extendable away from and towards the pedestal, and a player tracking card reader positioned within the button deck and accessible through a slot in a front edge of the button deck.

BRIEF DESCRIPTION OF THE DRAWINGS

FIG. 1 is a perspective view of a gaming machine in accordance with an example embodiment of the present disclosure.

FIG. 2 is a perspective view of a lower portion of the game cabinet in accordance with an example embodiment of the present disclosure.

FIG. 3 is an enlarged perspective view of the button deck shown in FIG. 1.

FIG. 4 is an illustration of embodiments of connections of the button deck to the column.

Although specific features of various embodiments may be shown in some drawings and not in others, this is for convenience only. Any feature of any drawing may be referenced and/or claimed in combination with any feature of any other drawing.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

The following detailed description illustrates embodiments of the disclosure by way of example and not by way of limitation. It is contemplated that the disclosure has general application to gaming machine embodiments providing player comfort and ergonomic considerations in industrial, commercial, and residential applications.

The following description refers to the accompanying drawings, in which, in the absence of a contrary representation, the same numbers in different drawings represent similar elements.

Figure 1:
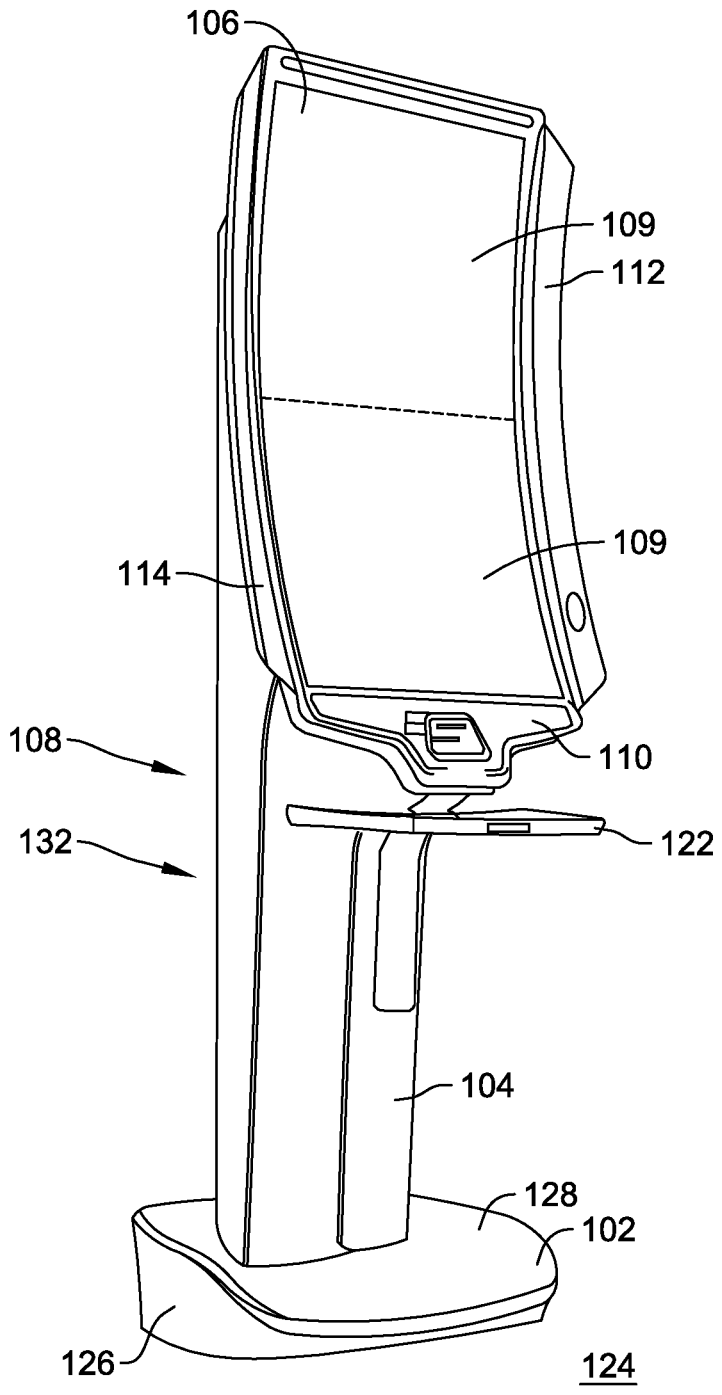
FIGS. 1-4 show example embodiments of the method and apparatus described herein.

FIG. 1 is a perspective view of a gaming machine 100 in accordance with an example embodiment of the present disclosure. In the example embodiment, gaming machine 100 includes a base 102 and a column 104 supported by base 102. A game cabinet 106 is coupled to an upper portion 108 of column 104. Game cabinet 106 includes one or more video display panels 109, a plurality of auxiliary devices, such as, but, not limited to a first user interface 110, a first side panel 112, and a second side panel 114. Gaming machine 100 also includes a button deck 122 adjustably coupled to column 104, game cabinet 106, and/or first user interface 110.

In the example embodiment, base 102 is configured to rest on or be coupled to a lower horizontal surface such as, but, not limited to, a floor 124. Base 102 includes one or more vertically upwardly extending sidewalls 126, which may include straight panels, and/or curved and contoured panels, such as, but, not limited to a circular, oval, oblong, and/or irregularly curved cross-section. Base 102 includes an upper surface 128 configured to fair base 102 by producing a closed smooth outline, support column 104, and/or provide a resting place for a user's feet.

Column 104 is a rigid, relatively slender, upright support, composed of relatively few components that extends vertically between base 102 and game cabinet 106. In various embodiments, column 104 includes a cylindrical or polygonal shaft 132. Column 104 houses various components and conduits that are configured to support the operation of gaming machine 100 and its integration into a larger operation and control network (not shown), in which gaming machine 100 is in communication.

Figure 2:
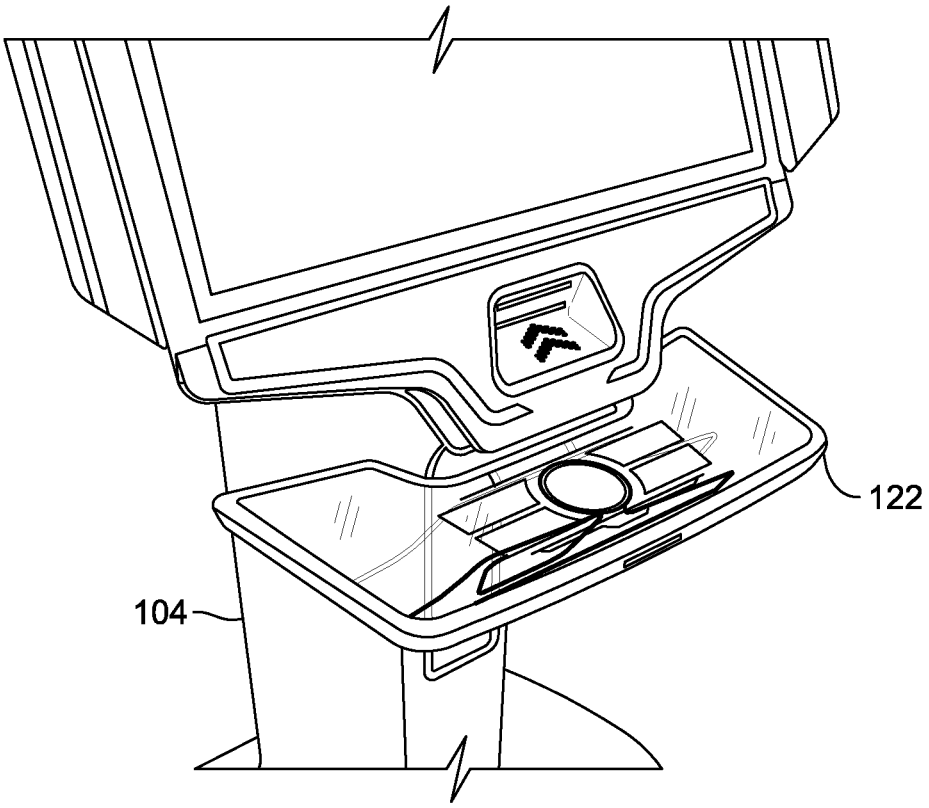

In various embodiments, button deck 122 is mounted to column 104 and is controlled through a gaming machine 100 controller (not shown in FIGS. 1 and 2). In one embodiment, button deck 122 is configured to translate with respect to column 104 in a single direction, for example, towards and away from column 104. In some embodiments, the translation is controlled manually by the user, automatically by a motor, or combinations thereof. For example, when gaming machine 100 detects a user entering a proximity of gaming machine 100, button deck 122 may be commanded to translate in either direction to indicate to the user that button deck 122 is movable. The user may then adjust button deck 122 manually by hand, manually through operation of a switch controlling the button deck motor, or allow button deck 122 to be controlled automatically by gaming machine 100. The user may also turn off the automatic translation feature using an override switch (not shown). Button deck 122 may be configured to translate in a plurality of directions and/or rotate around a plurality of axes to suit the user's comfort and ergonomic control.

Figure 3:
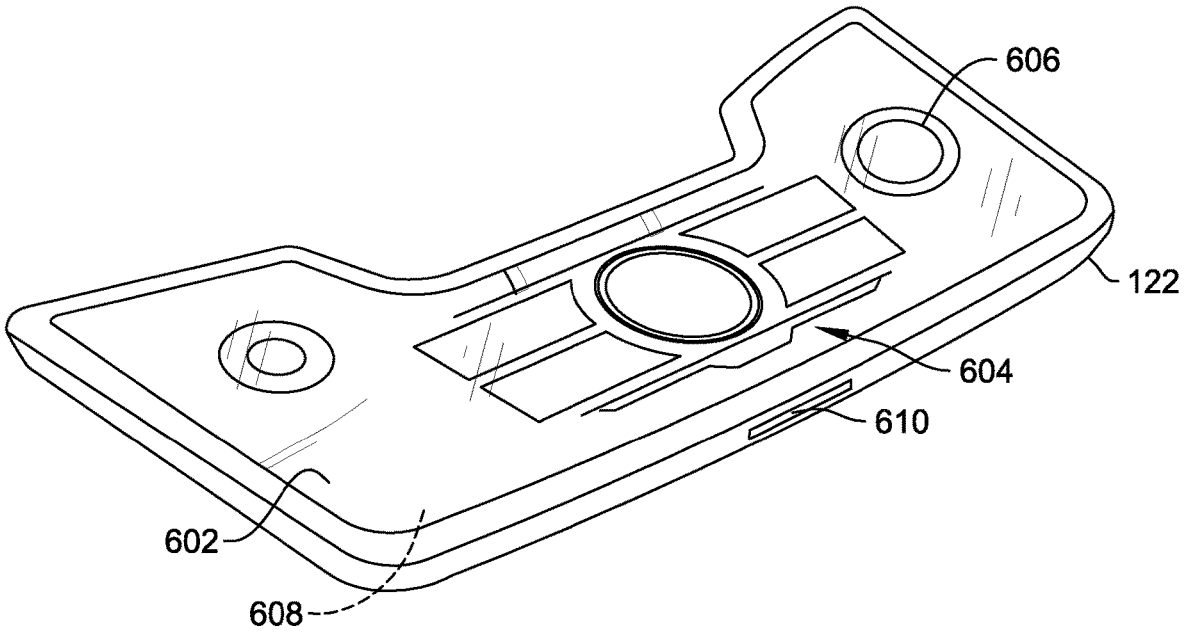

FIG. 2 is a perspective view of a lower portion of game cabinet 106 in accordance with an example embodiment of the present disclosure. FIG. 3 is an enlarged perspective view of button deck 122. In the example embodiment, button deck 122 includes an upper input surface 602 that may be embodied in a touchscreen surface or may be embodied in a combination of touchscreen elements 604 and mechanical input devices 606. For example, upper input surface 602 may include touchscreen elements for inputting various wager amounts, a "service" call button, a "cash-out" button, and other input requirements and also include a mechanical "spin" button 606. Touchscreen elements 604 may be isolated to certain areas of surface 602 and may be fixed in their function. However, in some embodiments, touchscreen elements 604 may be relocatable on surface 602 and may be reconfigurable to perform different functions during different portions of a game or for different games, such as when game cabinet 106 is interchanged. In one embodiment, button deck 122 is at least partially transparent or translucent, which permits a user to see through button deck 122, permits light from sources below button deck 122 to be seen by the user, and gives an appearance of mechanical "spin" button 606 and touchscreen elements 604 floating in front of the user.

Upper input surface 602 also may include an element 608 configured to control an opacity of button deck 122. Element 608 may comprise a liquid crystal display (LCD) element or other element configured to be electrically controlled to alter its transmissive properties. Element 608 may be configured to control opacity of button deck 122 as a whole or may be configured to control smaller regions of button deck 122 to present graphical objects to the user.

Button deck 122 also includes a card reader 610 for player tracking and communication. Card reader 610 is a part of a player tracking system that receives a player tracking card inserted and removed by the user. Card reader 610 transfers information stored on a player card to gaming machine 100. Gaming machine 100 is configured to provide player information on a player information portion (not shown in FIG. 6) of video display panel 109. In one embodiment, the player information portion is a reserved area that can be observed during game play. In other embodiments, the player information portion is overlaid onto a game screen during play or between games. When the player information portion is reserved, player information may only be displayed during predetermined times or when activated by the user. In other embodiments, the player information is dimmed or grayed out so as not to detract from the appearance of the game during game play.

Figure 4:
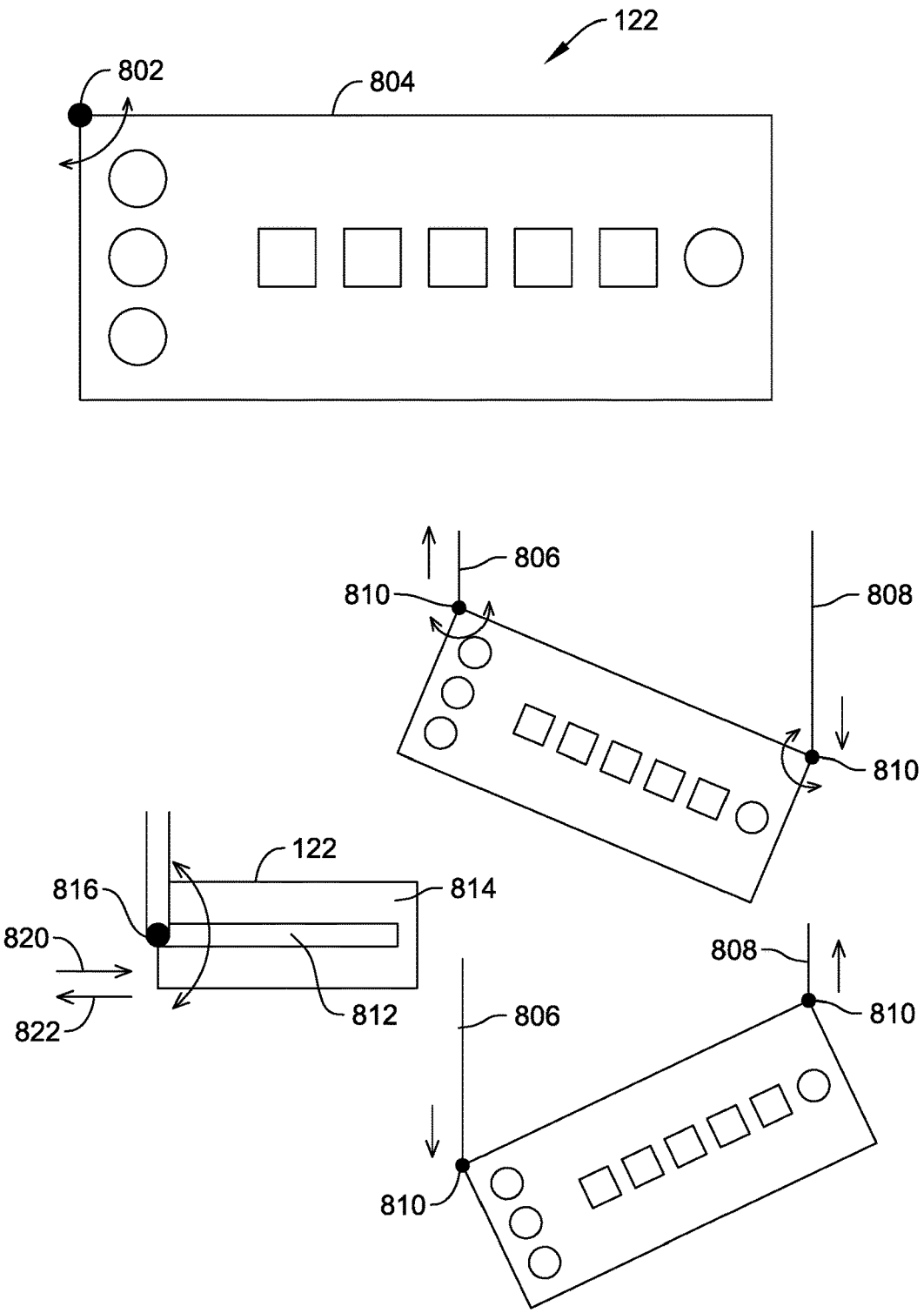

FIG. 4 is an illustration of embodiments of connections of button deck 122 to column 104. In a first alternative embodiment, button deck 122 is pivotally coupled to column 104 through a pivot point 802 located along a rear edge 804 of button deck 122. In the example embodiment, pivot point 802 is positioned in a corner of button deck 122, however pivot point 802 can be located at any position along rear edge 804. A second alternative embodiment includes a first support arm 806 and a second support arm 808. In the example embodiment, support arms 806 and 808 are telescoping in that one of first support arm 806 and second support arm 808 may be extended at different rates and/or distances to permit button deck 122 to be angled with respect to column 104. Such an orientation may be beneficial to, for example, a user that is not positioned directly in front of gaming machine 100. To support such movement, a connection point 810 between first support arm 806 and second support arm 808 and button deck 122 is pivotable about connection point 810. A third alternative embodiment is illustrated where a track 812 along an underside 814 of button deck 122 is configured to receive a pivotable knob 816 coupled to an arm 818 extending from column 104. During operation, button deck 122 can be translated laterally along track 812 in a first direction 820 or a second direction 824 and/or rotated about knob 816 at any point along track 812.

This written description uses examples to describe the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A gaming machine pedestal comprising:

a column;

a button deck adjustably coupled to said column;

a first extendable arm and a second extendable arm coupling said button deck to said column, each arm coupled at a first end to said column and at a second end to said button deck, said first and second arms being telescopingly extendable independent of each other along a first direction away from and towards said column; and a first pivotable connector coupling said first extendable arm to said button deck and a second pivotable connector coupling said second extendable arm to said button deck, wherein said first and second pivotable connectors facilitate pivoting the button deck about offset rotational axes that extend through the first and second pivotable connectors, respectively, and are perpendicular to the first direction.

2. The gaming machine pedestal of claim 1, wherein said button deck extends between a front edge of the button deck and an opposed rear edge, wherein said first and second pivotable connectors are each positioned at said rear edge.

3. The gaming machine pedestal of claim 2, wherein said button deck further comprises a first side and a second side each extending from said rear edge to said front edge, said button deck extending laterally between said first side and said second side, and wherein said first pivotable connector is positioned adjacent said first side and said second pivotable connector is positioned adjacent said second side.

4. The gaming machine pedestal of claim 3, wherein said first pivotable connector is coupled between said first extendable arm and said button deck and said second pivotable connector is coupled between said second extendable arm and said button deck.

5. The gaming machine pedestal of claim 3, wherein said button deck defines a first corner at an intersection of said rear edge and said first side, said button deck further defining a second corner at an intersection of said rear edge and second side, and wherein said first pivotable connector is positioned at said first corner and said second pivotable connector is positioned at said second corner.

6. The gaming machine pedestal of claim 1 further comprising one or more knobs each coupling said one or more extendable arms to said button deck, said button deck defining a track sized to receive said one or more knobs therein.

7. The gaming machine pedestal of claim 1 further comprising an actuator configured to facilitate extending said button deck away from and towards said column.

8. The gaming machine pedestal of claim 1, wherein said first pivotable connector is positioned at a first corner of said button deck and said second pivotable connector is positioned at a second corner of said button deck.

9. The gaming machine pedestal of claim 8, wherein the first corner is defined at an opposite side of said button deck from said second corner.

10. The gaming machine pedestal of claim 1, wherein the button deck is adjustable relative to the column to position the button deck in a first orientation, in which a length of the first extendable arm is greater than a length of the second extendable arm, and a second orientation relative to the column, in which the length of the second extendable arm is greater than the length of the first extendable arm.

11. The gaming machine pedestal of claim 10, wherein the button deck is oriented at a first angle relative to the column when in the first orientation, the button deck being oriented at a second, different angle relative to the column when in the second orientation.

12. The gaming machine pedestal of claim 1 further comprising a player tracking card reader positioned within said button deck and accessible through a slot in a front edge of said button deck.

13. A gaming machine pedestal comprising:

a column;

a button deck adjustably coupled to said column, wherein said button deck comprises an upper surface comprising a transparent touchscreen element, a lower surface opposite said upper surface, and a button deck body extending therebetween;

one or more extendable arms coupling said button deck to said column, each arm coupled at one end to said column and at a second end to said button deck, said button deck extendable away from and towards said column;

one or more knobs each coupling said one or more extendable arms to said button deck, said button deck defining a track within said lower surface sized to receive said one or more knobs therein; and a player tracking card reader positioned within said button deck and accessible through a slot in a front edge of said button deck.

14. The gaming machine pedestal of claim 13, wherein said button deck is extendable via said one or more extendable arms in a first direction away from and towards said column, and wherein said button deck is slidable relative to said one or more knobs in a second direction laterally of said column.

15. The gaming machine pedestal of claim 14, wherein the second direction is substantially perpendicular to the first direction.

16. The gaming machine pedestal of claim 14, wherein said button deck is rotatable about said one or more knobs to adjust an orientation of said button deck relative to said column.

17. A gaming machine comprising:

a base;

a columnar pedestal extending vertically from said base to an upper portion;

a cabinet coupled to the upper portion of said pedestal and comprising a game display;

a button deck adjustably coupled to said pedestal;

a first extendable arm and a second extendable arm coupling said button deck to said pedestal, each arm coupled at a first end to said pedestal and at a second end to said button deck, said first and second arms being telescopingly extendable independent of each other along a first direction away from and towards said pedestal; and a first pivotable connector coupling said first extendable arm to said button deck and a second pivotable connector coupling said second extendable arm to said button deck, wherein said first and second pivotable connectors facilitate pivoting the button deck about offset rotational axes that extend through the first and second pivotable connectors, respectively, and are perpendicular to the first direction.

18. The gaming machine of claim 17, wherein said button deck extends between a front edge of the button deck and an opposed rear edge, wherein said first and second pivotable connectors are each positioned at said rear edge.

19. The gaming machine of claim 18, wherein said button deck further comprises a first side and a second side each extending from said rear edge to said front edge, said button deck extending laterally between said first side and said second side, and wherein said first pivotable connector is positioned adjacent said first side and said second pivotable connector is positioned adjacent said second side.

20. The gaming machine of claim 19, wherein said first pivotable connector is coupled between said first extendable arm and said button deck and said second pivotable connector is coupled between said second extendable arm and said button deck.

* * * * *